United States Patent [19]

Vander Syde et al.

[11] Patent Number: 4,784,379

[45] Date of Patent: Nov. 15, 1988

[54] APPARATUS AND METHOD FOR AUTOMATED MAIL

[75] Inventors: Gary L. Vander Syde, Naperville; Paul Beatty, Chicago; Myron A. Bowles, Waukegan; Kenneth L. Guenther, Park Ridge; K. George Rabindran, Morton Grove, all of Ill.; Gerald D. Warden, Easton, Pa.; Michael A. Wisniewsi, Bolingbrook; Kenneth Viani, Morton Grove, both of Ill.

[73] Assignee: Bell & Howell Company, Chicago, Ill.

[21] Appl. No.: 30,044

[22] Filed: Mar. 24, 1987

[51] Int. Cl.[4] ..... B65H 39/02

[52] U.S. Cl. ..... 270/55; 53/206; 53/266 A; 493/424; 493/437; 270/58

[58] Field of Search ..... 270/45, 55, 58; 53/206, 53/266 A, 569, 55, 578–579; 493/409, 416, 417, 442, 447, 453, 454, 210, 212, 216, 397–400, 402–403, 424, 437–438

[56] References Cited

U.S. PATENT DOCUMENTS

| | | | |
|---|---|---|---|
| 2,325,455 | 7/1943 | Williams | 53/266 A |
| 2,736,999 | 3/1956 | Rouan et al. | 53/266 A |
| 3,059,391 | 10/1962 | Volks et al. | 53/266 A |
| 3,260,517 | 7/1966 | Sather | 270/58 |
| 3,387,841 | 6/1968 | Menell et al. | 493/442 |
| 3,965,644 | 6/1976 | Stockes | 270/58 |
| 4,071,997 | 2/1978 | Gunther, Jr. et al. | 53/206 X |
| 4,105,197 | 8/1978 | Pott | 493/416 |
| 4,299,073 | 11/1981 | Golicz et al. | 53/206 |
| 4,449,351 | 5/1984 | Henderson | 53/266 A |
| 4,464,878 | 8/1984 | Golicz et al. | 53/206 |
| 4,524,557 | 6/1985 | Silverman et al. | 53/266 A |
| 4,577,848 | 3/1986 | Hams | 270/58 |
| 4,582,312 | 4/1986 | Abrams et al. | 270/58 |
| 4,604,849 | 8/1986 | Zemke et al. | 53/266 A |
| 4,606,784 | 8/1986 | Glans et al. | 493/442 |
| 4,668,212 | 5/1987 | Kotani | 493/210 X |
| 4,694,632 | 9/1987 | Gunther, Jr. | 53/206 |

*Primary Examiner*—Eugene H. Eickholt

*Attorney, Agent, or Firm*—Neuman, Williams, Anderson & Olson

[57] ABSTRACT

Apparatus and method for automatically preparing large mailings in which one or more documents are nested within the fold of a letter sheet prior to insertion into an outer envelope. One or more unfolded letter sheets are transported to a folding operation involving a clamp assembly and a roller folding assembly which is movable into engagement with the clamp assembly. After folding and prior to stuffing into an envelope, one or more inserts can be inserted within the folded letter sheet.

57 Claims, 5 Drawing Sheets

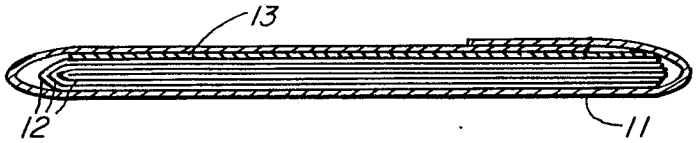
FIG. 2
PRIOR ART
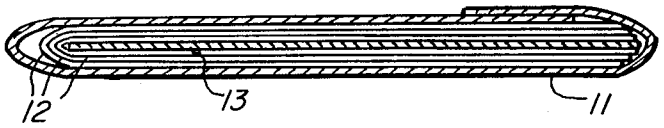
FIG. 1
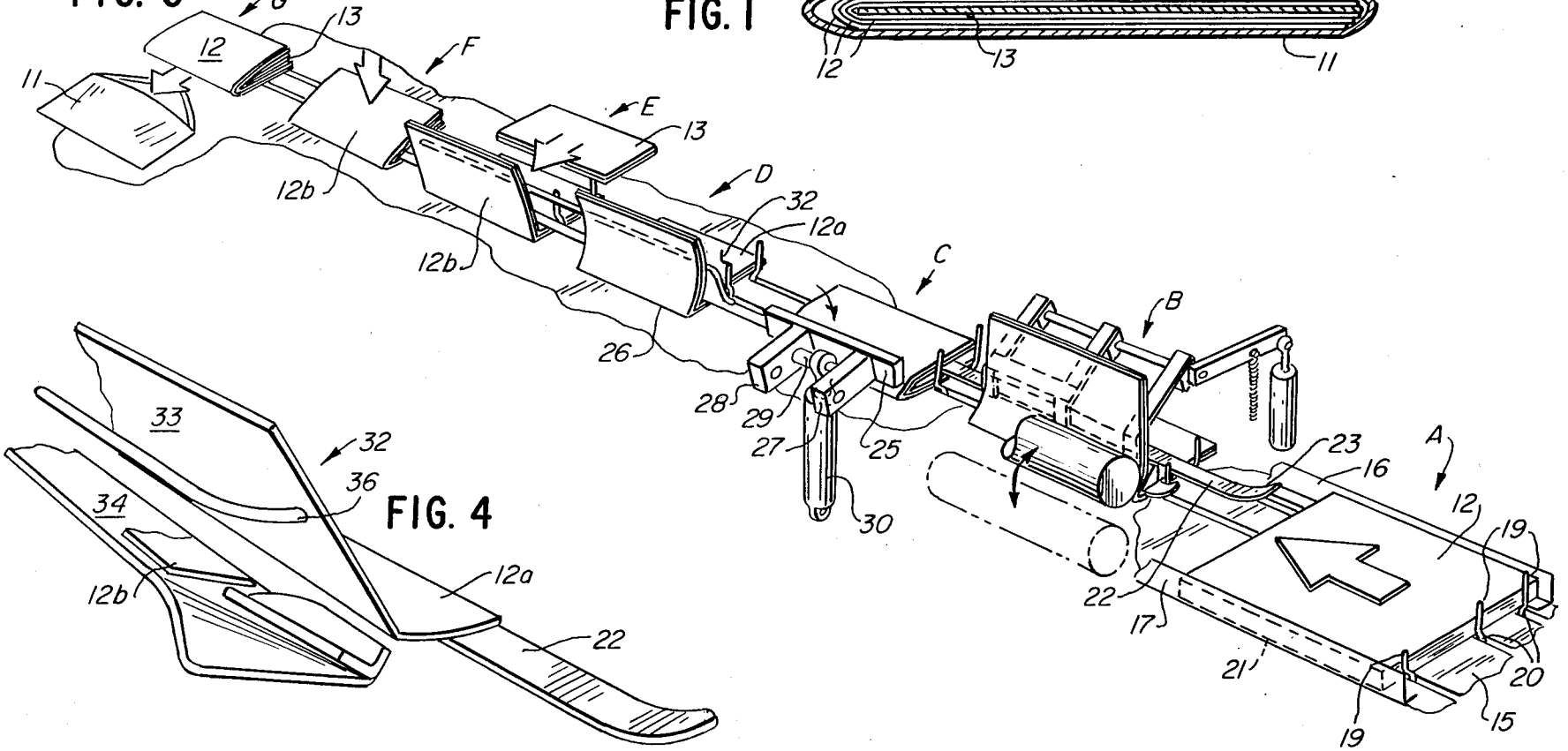
FIG. 3
FIG. 4

APPARATUS AND METHOD FOR AUTOMATED MAIL

BACKGROUND OF THE INVENTION

This invention relates generally to the art of automated in-line mailing systems and more particularly to apparatus and methods for preparing large or mass mailings.

Many businesses send out mass mailings which may include one or more letter sheets with which there are enclosed one or more inserts such as documents advertising products or services, special announcements, response cards and frequently a return envelope. Monthly billing statements of retail department stores and utility companies are typical of such large mailings.

Automated in-line mailing (AIM) systems have been designed and are widely used to accomplish such mass mailings. Such systems may typically include a page sheet feeder, a burster for perforated webs or a cutter which receives a preprinted sheet web which it cuts into individual sheets. These sheets are sequentially, automatically, fed to the register table which straightens and feeds them to a folder. The folder, in turn, folds the sheets into appropriate sizes and feeds them to a collector which collects the folded sheets until a set corresponding to one letter is collected. The collector then ejects or "dumps" the set, or letter, onto an insert raceway which moves the letter past insert stations. Appropriate inserts are deposited at the insert stations onto the letter. Thereafter, the inserts and letter are stuffed into a mailing envelope which is closed for mailing. Such a system is disclosed in U.S. Pat. No. 4,582,312, the disclosure of which is incorporated herein.

Obviously, it is desired that the attention of the mail recipients be directed to all of the inserts enclosed with the principal letter or monthly statement. However, it frequently happens that one or more of the inserts are not removed from the mailing envelope along with the letter or monthly statement and consequently are ignored by the customer or credit user. This may occur because the inserts are not placed within the folded letter or monthly statement but merely stacked thereon and the recipient is not careful in removing the contents of the mailing envelope and does not make sure that it is completely empty.

It is therefore a principal object of this invention to provide for automatic mailing of multiple documents in a manner which minimizes the possibility of one or more documents not being removed from the mailing envelope by the mail recipient.

It is another object of this invention to provide an advantageous method and apparatus for automatically preparing a mailing in which all of the contents of the envelope can be removed therefrom simultaneously.

It is another object of this invention to provide an advantageous method and apparatus for automatically placing one or more inserts within the center fold of a folded letter sheet or set of letter sheets.

It is a further object of this invention to provide a method and apparatus whereby a relatively large number of letter sheets can be used to form a set having one or more inserts nested within the center fold of folded letter sets.

It is a still further object of the invention to provide a method and apparatus whereby one or more inserts can be automatically placed at a fast rate within the center fold of a folded letter sheet or set of letter sheets and the entire assembly inserted into a mailing envelope.

SUMMARY OF THE INVENTION

According to this invention, novel letter sheet folding and spreader means are included in document handling apparatus such that a desired number of document inserts can be placed within the center fold of a folded letter sheet or set of folded letter sheets and stuffed within a mailing envelope in such nesting relationship. Upon removal of the folded letter sheet from the mailing envelope all of the contents, including the document inserts, are likewise removed therefrom because they are contained within the folded letter.

One preferred mailing system of this invention involves, in general, document handling apparatus which comprises means for transporting at least one letter sheet with information indicia thereon along a transport path adjacent document handling means which includes at least one document insert station. Means are provided upstream of the first document insert station for folding or creasing the letter sheet or set of letter sheets. Means are also provided upstream of the first insert station for spreading the folds of the letter sheet at the center and maintaining the folds in spread or open position at each document insert station whereby the document inserts are inserted between the folds of the letter sheet. Means are provided to close the spread fold downstream of the last document insert station and an envelope stuffing station is provided downstream of the closer means at which the letter sheet with all of the inserts nested between the folds are stuffed into a mailing envelope.

The letter sheet folding and spreading means of this invention can be readily incorporated in conventional mail inserting machines wherein a folded letter sheet to be mailed is pushed along a raceway by chain-mounted pins in an intermittent manner from station to station. As a letter comes in front of each of the document insert stations, a reciprocating gripper-jaw or jaws grip a bottom-most insert from an insert stack, pulls it over the raceway and releases it to drop on top of the folded letter sheet. However, in accordance with this invention, at the document insert station the insert is not dropped on top of the folded letter sheet but is dropped on the lower fold of the folded but spread letter sheet. When such a letter/insert set arrives at the envelope stuffing station, pusher fingers drive the set into a waiting open envelope which is fed from an envelope stack by feed fingers and held open by a suction pivot arm. Automatic mail inserting apparatus is described in numerous patents, such as U.S. Pat. Nos. 2,325,455, 3,260,517, 3,965,644, 4,577,848, 4,582,312, 4,604,849 and others.

Various feeder mechanisms are well known in the art which can be used to feed a preprinted letter sheet of a desired size onto a transport raceway of an insertion machine in accordance with this invention. Known feeder mechanisms are capable of taking a preprinted continuous web of paper, such as computer generated billing statements, cutting the web into sheets of desired size and depositing them on the transport raceway. Similarly, the various linkages and controls that synchronize operations of the transport raceway, the document insert stations and envelope stuffing station are well known in the art and the known prior art elements can be used with this invention.

In practicing the present invention, one or more letter sheets are deposited from suitable feeder means onto a transport raceway. The letter sheet or an aligned stack of such sheets are then folded as desired either at the exact center or at a location offset from the center. The folded sheet or stack of sheets are then spread open at the center fold and are conveyed in an intermittent manner past a desired number of document insert stations whereat insert documents are inserted on top of the lower fold of the letter sheet or stack of sheets. The folds of the letter sheet are maintained in an open or spread position at each of the document insert stations. Eventually, after insertion of all of the desired insert documents, the open or spread fold is at least partially reclosed with the document inserts nesting within the folded letter. The closed stack of folded letter sheets with inserts nested inside is then the stuffed into a waiting open mailing envelope at a stuffing station. After stuffing, the mailing envelope and its contents can be transported to a sealing and metering station for mailing.

BRIEF DESCRIPTION OF THE DRAWINGS

The operation and advantages of the present invention will be fully appreciated by the following description of preferred embodiments taken in conjunction with the accompanying drawings in which:

FIG. 1 is a view illustrating a mailing envelope prepared in accordance with the present invention containing a plurality of letter sheets and having an insert document nested within the folded letter sheets.

FIG. 2 is a view illustrating a mailing envelope prepared in accordance with the prior art automated mailing procedures containing a plurality of letter sheets and having an insert document lying outside the folded letter sheets.

FIG. 3 is a diagrammatic view illustrating various steps in the method of the present invention for preparing a mailing.

FIG. 4 is a partial perspective view of one form of means to spread and maintain open the flaps of a folded letter sheet during document insertion operations.

DESCRIPTION OF PREFERRED EMBODIMENTS

Figures 5, 6, 10:
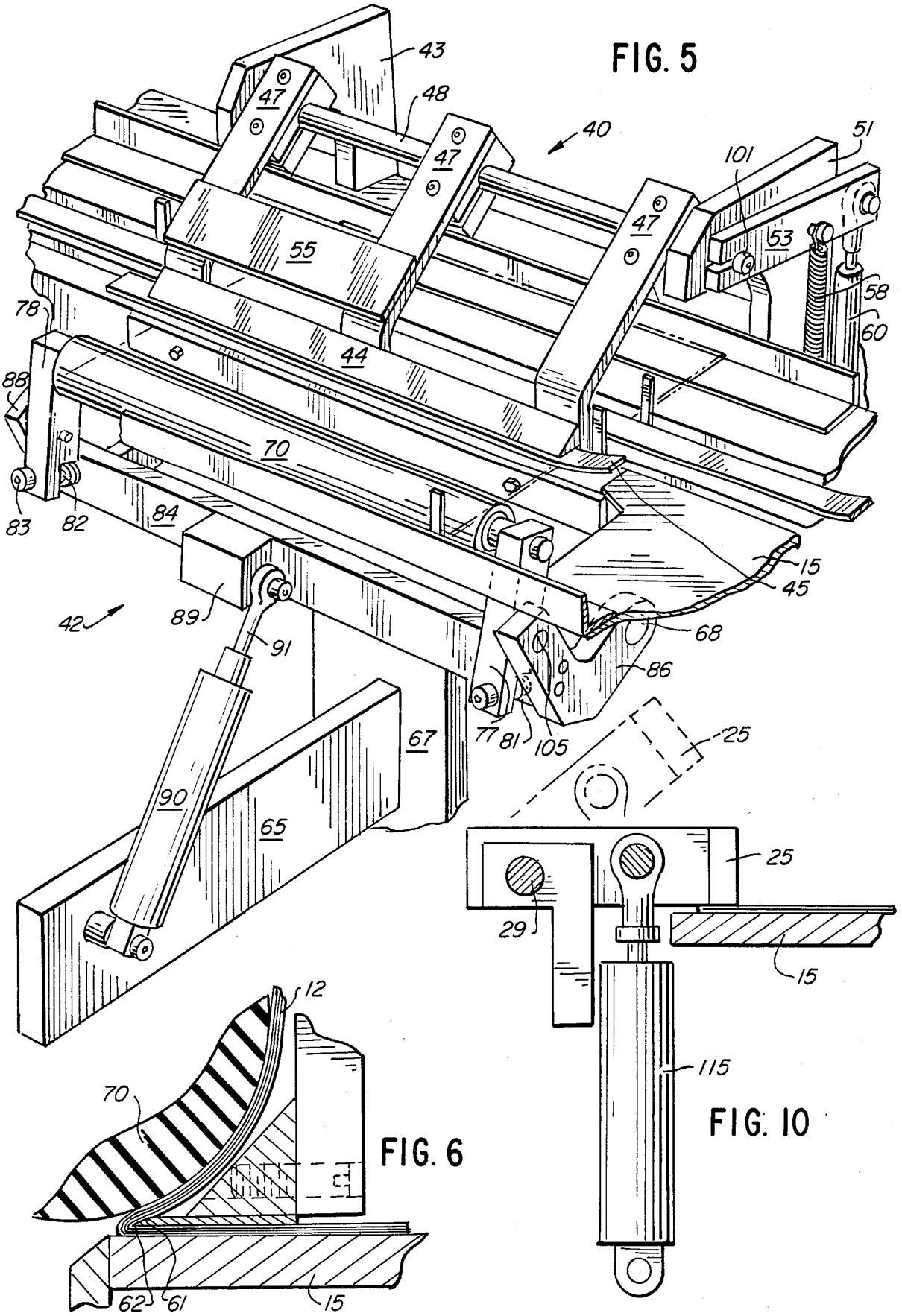
FIG. 5 is a perspective view showing the principal elements of one preferred means for folding or creasing a letter sheet or sheets prior to insertion of document inserts therein.
FIG. 6 is a side elevation view of a part of the preferred folding means illustrated in FIG. 5.
FIG. 10 is a partial side elevational view of a second fold means which can be optionally employed in accordance with the invention.
Figure 7:
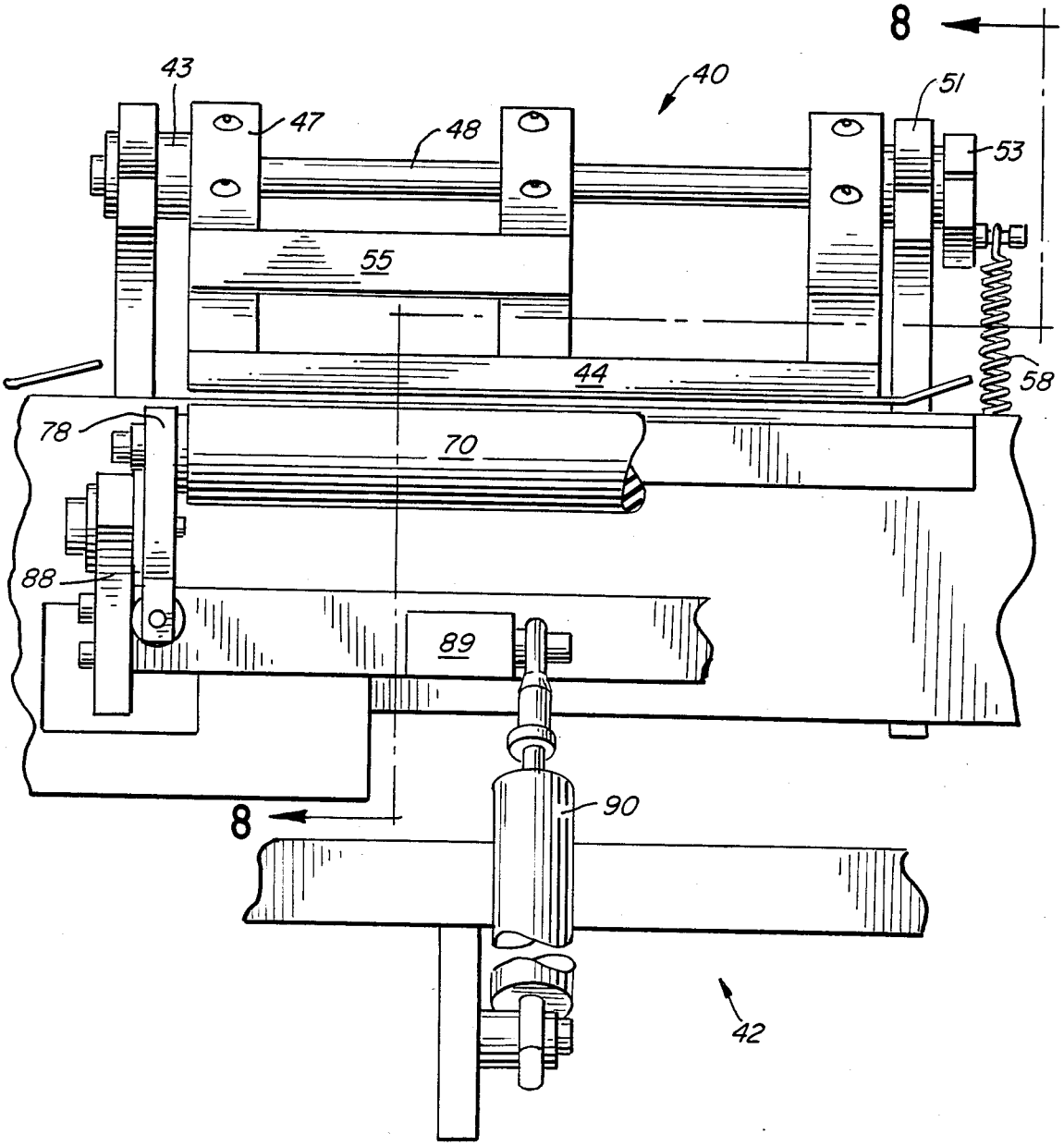
FIG. 7 is a partial front view of the preferred folding means illustrated in FIG. 5.

In FIGS. 1 and 2 a mailing envelope 11 contains a plurality of folded sheets 12 such as a monthly multipage telephone statement with which there is enclosed a document insert 13 such as a special announcement. With prior art automated mailing systems the insert 13 as illustrated in FIG. 2 lies outside of the folded statement 12 permitting removal of the statement from the envelope without removal of the special announcement insert 13. In contrast, by means of the present invention the special announcement 13 nests within the folds of the statement sheets 12 which insures that the announcement is removed from the mailing envelope simultaneously with the statement, thus attracting the attention of the mail recipient as is intended.

FIG. 3 illustrates schematically the automatic preparation of mail in accordance with the present invention. It is often desired to prepare a mailing which includes a plurality of letter pages or sheets and the apparatus of the invention is adapted to handle a stack including say ten or twelve letter sheets. Thus, a letter sheet 12 or a plurality of such sheets fed from a suitable feeding mechanism are deposited at station A on a transport raceway 15 and are aligned in registry between the upstanding guide rails 16 and 17 which extend longitudinally along the sides of raceway 15. The letter sheet 12 is pushed in intermittent manner along the raceway in the direction of the arrow by means of pusher pins 19 mounted on drive chains 20 and 21. The drive chains form a continuous loop with the drive chain 20 extending the entire length of the system from station A to the envelope stuffing system G. The drive chain 21 extends only as far as station B. The unfolded sheet passes under hold-down strip 22 which extends in longitudinal direction closely spaced from the raceway 15 so as to provide clearance for the sheet to pass therebeneath. The hold-down strip 22 can take the form of a bar having an upturned forward edge 23 or it can be in the form of a brush with the bristles contacting the sheet and maintaining it in substantially flat condition.

The letter sheet then undergoes a folding operation at station B. Various means of folding the letter sheet can be employed and it is desired that the fold be accomplished in a manner to provide a sharp crease line. One particularly preferred folding means is illustrated in FIGS. 5 through 9 and will hereinafter be described with greater particularity.

According to an optional embodiment of the invention, the letter sheet can then be subjected to a second folding step at station C, if desired. The second folding step reinforces the initial crease line and may be desirable when a relatively large stack of letter sheets are being processed. The second folding operation at station C is accomplished by means of a press bar 25 having a generally flat lower surface which is adapted for reciprocating movement between an open or upper position and a closed or folded position in which it tightly clamps the previously folded sheet against the surface of the raceway along the crease line 26 to reinforce the crease line. The press bar 25 is attached to arms 27 and 28 which are pivotable on pivot shaft 29. The press bar 25 is operated by means of a double acting air cylinder 30 of known type. The location of the center of the fold is maintained by the hold-down strip 22 that is located above the section 12*a* of the folded letter sheet and beneath section 12*b* of the folded piece.

After completion of the folding operation the creased or folded letter sheet 12 is ready to receive a desired number of insert documents by being transported to a desired number of insert document stations. To insure that the insert documents are inserted within the fold of the sheet rather than being dropped on the outside thereof as in prior art processing, a flap spreading means 32 is employed at station D downstream of the folding operation and upstream of the first document insert station E.

In general, the flap spreading means 32 comprises an intercept element positioned along the transport raceway which comes between the flaps 12*a* and 12*b* of the folded letter sheet so as to maintain them in separated or open position permitting document inserts to be placed therewithin. One form of flap spreading means, partially illustrated in FIG. 4, takes the form of a trough having sides 33 and 34 joined in a V-shape. The spreading means 32 extends longitudinally to and spaced above the raceway so that side wall 33 intercepts and comes between the flaps 12*a* and 12*b* of the folded letter sheet. When the folded letter sheet 12 is advanced so as to contact the spreading means, the upper or free flap 12*b* of the letter is guided into the V-shaped trough and passes therethrough with the upstanding side wall 33 preventing it from closing and interfering with insertion of the document inserts. An inwardly projecting smooth guide rod 36 on the inner side wall 33 guides the free flap 12*b* of the letter sheet and prevents it from engaging the side wall 33 and possibly being snagged thereon and also to reduce drag which tends to skew the letter piece, which could possibly cause jamming of the system. The flap spreading means 32 extends longitudinally along the transport raceway a sufficient distance such that the flaps 12*a* and 12*b* of the folded sheet are maintained in an open position at each of the document insert stations E.

Any number of document insert stations E can be employed, only one being illustrated in FIG. 3.

After placement of the final document insert, the free flap 12*b* is preferably passed by station F where a closer ram or arm (not shown) serves to push the fold 12*b* inwardly at least to a vertical position prior to its arrival at an envelope stuffing station G. At the envelope stuffing station G, pusher fingers drive the set in known manner into a waiting open envelope. The envelope is fed from an envelope stack by feed jaws and is held open by a suction pivot arm.

The principal operating elements of one preferred means for folding the letter sheet at station B prior to insertion of document inserts is illustrated in detail in FIGS. 5 through 9. This preferred folding means involves two cooperating reciprocating elements - a clamp folding assembly designated generally by the numeral 40 and a roller folding assembly designated generally by the numeral 42. Clamp folding member 40 is suitably supported by support 43 and 51 on one side of the transport raceway and consists of a generally flat rigid crease bar 44 which preferably has an upturned leading edge portion 45 under which a letter sheet passes. Crease bar 44 is secured to rocker arms 47 which are carried by shaft 48. The ends of shaft 48 are journaled between supports 43 and 51 at each side thereof. Shaft 48 is rotatably activated by lever 53 which is fixedly attached to shaft 48. Lever 53 is activated upwardly by an air cylinder 60 connected in a pivotal manner between lever 53 and the frame for the overall inserter apparatus. Lever arm 53 is normally biased downwardly by spring 58. By means of a double acting two-way air cylinder 60 acting through the pivot lever 53, the crease bar 44 is caused to reciprocate in a substantially vertical direction between an upper non-clamping position and a lower sheet creasing position in which it clamps the letter sheet by compressing it against the surface of the raceway, readying it for folding by roller folding assembly 42.

The crease bar 44, in preferred form, has a bevelled forward portion 61 (FIG. 6) terminating in knife edge 62 which is desired for obtaining a sharp, tight fold.

Roller folding assembly 42 cooperates with the clamp assembly 40 to crease or fold a letter sheet or sheets 12 along the knife edge 62. The roller folding assembly 42 is positioned along the side of the transport raceway opposite clamp assembly 40 and is pivotally supported by shaft 68 which is journaled between blocks 69 which are fixed to the frame of the inserter apparatus and involve a rotatable roller member 70. Roller 70 can be formed of a hard rubber or like material and is integrally attached to and carried by axle 71. The distal ends of axle 71 are journaled through openings in pivotable levers 77 and 78 located at each end of the roller. The levers 77 and 78 have cut-away lower portions which are acted upon by compression springs 81 and 82.

The springs 81 and 82 also act upon a rigid drive bar 84 which is rigidly attached to L-shaped rocker elements 86 and 88 at each end thereof. The compression springs 81 and 82 are retained by cap screws 83, the heads of which act upon levers 77 and 78 and the bodies of which pass freely through levers 77 and 78 and springs 81 and 82, and which thread securely into drive bar 84. Adjustment of the free position of roller 70 is accomplished by cap screws 83. A boss element 89 secured to drive bar 84 is operatively engaged with rod 91 of a double-acting pneumatic cylinder 90.

The connecting linkages of the roller folding assembly 42 are activated by a double-acting pneumatic air cylinder 90 which is pivotally mounted between the inserter frame extension 65 and the drive bar 84. Activation of cylinder 90 to its extended position causes drive bar 84 and rocker elements 86 and 88 to pivot on shaft 68 in bearings of bearing blocks 69. Levers 77 and 78 which are pivotally mounted to roller elements 86 and 88 carry roller 70 upward until it engages the sheets to be folded. As roller 70 continues upward, it carries end 12*b* of the sheet to be folded upward and a fold line is established at knife edge 62 of the activated clamp assembly 40. As roller 70 continues upward, it meets an interference with the knife edge 62 with the end of the sheet 12*b* interposed between the roller 70 and the knife edge 62. As the pneumatic cylinder 90 continues to extend, it forces roller 70 over the end of the sheet 12*b* and the knife edge 62; as it does so, roller 70 and levers 77 and 78 pivot in the journals 105 of rocker arms 86 and 88 compressing springs 81 and 82. When multiple letter sheets are being processed, the folding mechanism is self-adjusting and compression springs 81 and 82 compress enough to enable folding of a wide range of thicknesses of paper stacks. When the pneumatic cylinder 90 is fully extended, the roller 70 has rolled the sheets to be folded completely over the knife edge and the fold has been accomplished. The pneumatic cylinder 90 is then reversed to drive it off of the fold and to its reset position.

The connecting linkages of the roller folding assembly 42 are such that upon activation of pneumatic cylinder 90 to its extended position the roller 70 contacts the knife edge 62 and rolls on the tapered or bevelled portion 61 on crease bar 44 of the clamp assembly 40. The rolling action results in the crease line 26 being reinforced on the letter sheet.

In operation, the letter sheet folding operation at station B is accomplished by intermittently advancing a letter sheet or stack of letter sheets to that station. A portion of the letter sheet lies beneath hold-down 22. At this time air cylinder 60, controlled by suitable electrical switches, is activated to cause the piston therewithin to move upwardly thereby forcing the rear portion of lever 53 upwardly, thereby moving the crease bar 44 downwardly as it pivots at pivot point 101 to clamp a paper sheet against the surface of the raceway.

Figure 8:
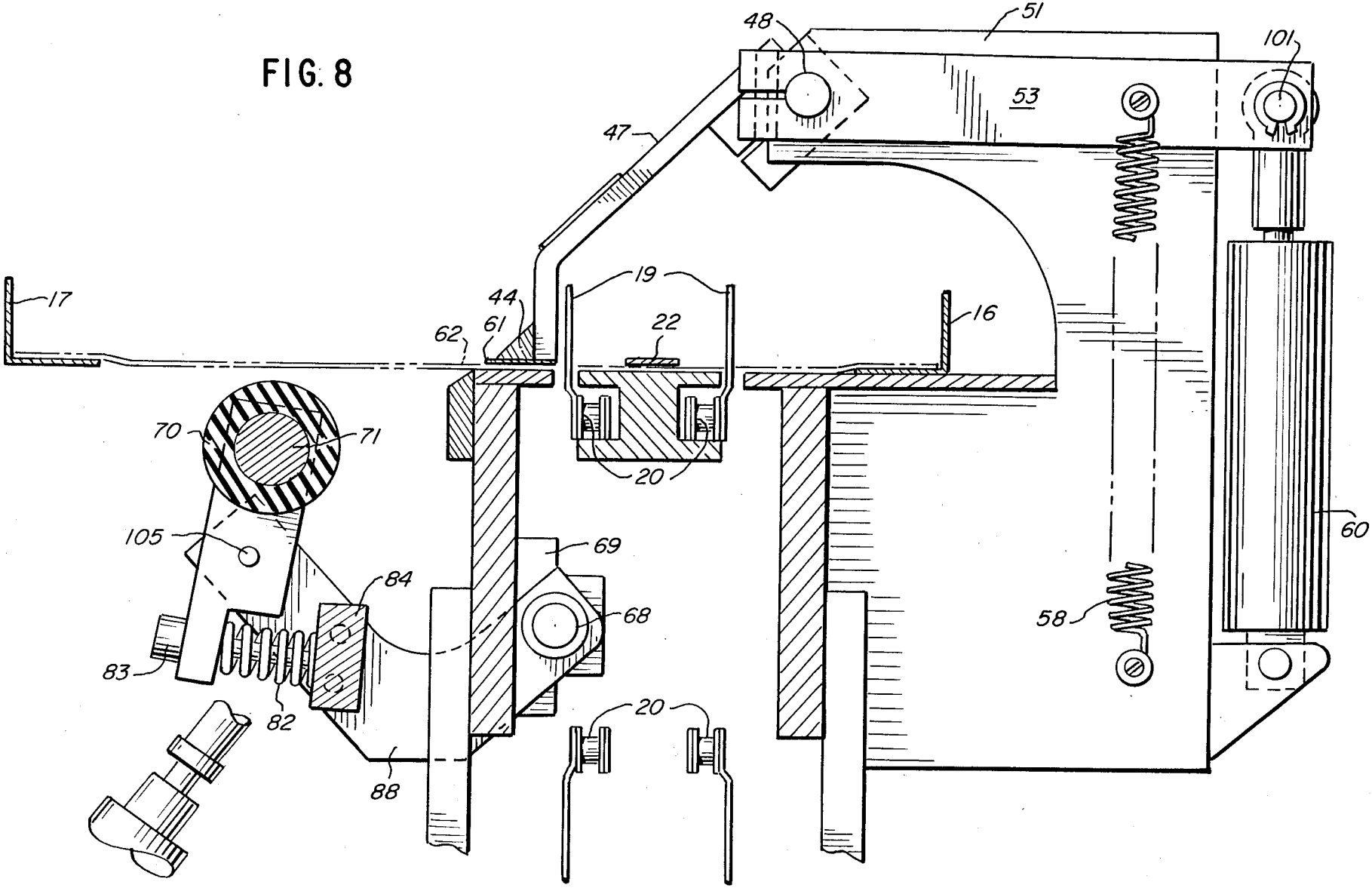
FIG. 8 is a sectional view taken on the line 8—8 of FIG. 7 showing the arrangement of parts of the preferred roller folding means when in retracted or nonfolding position.
Figure 9:
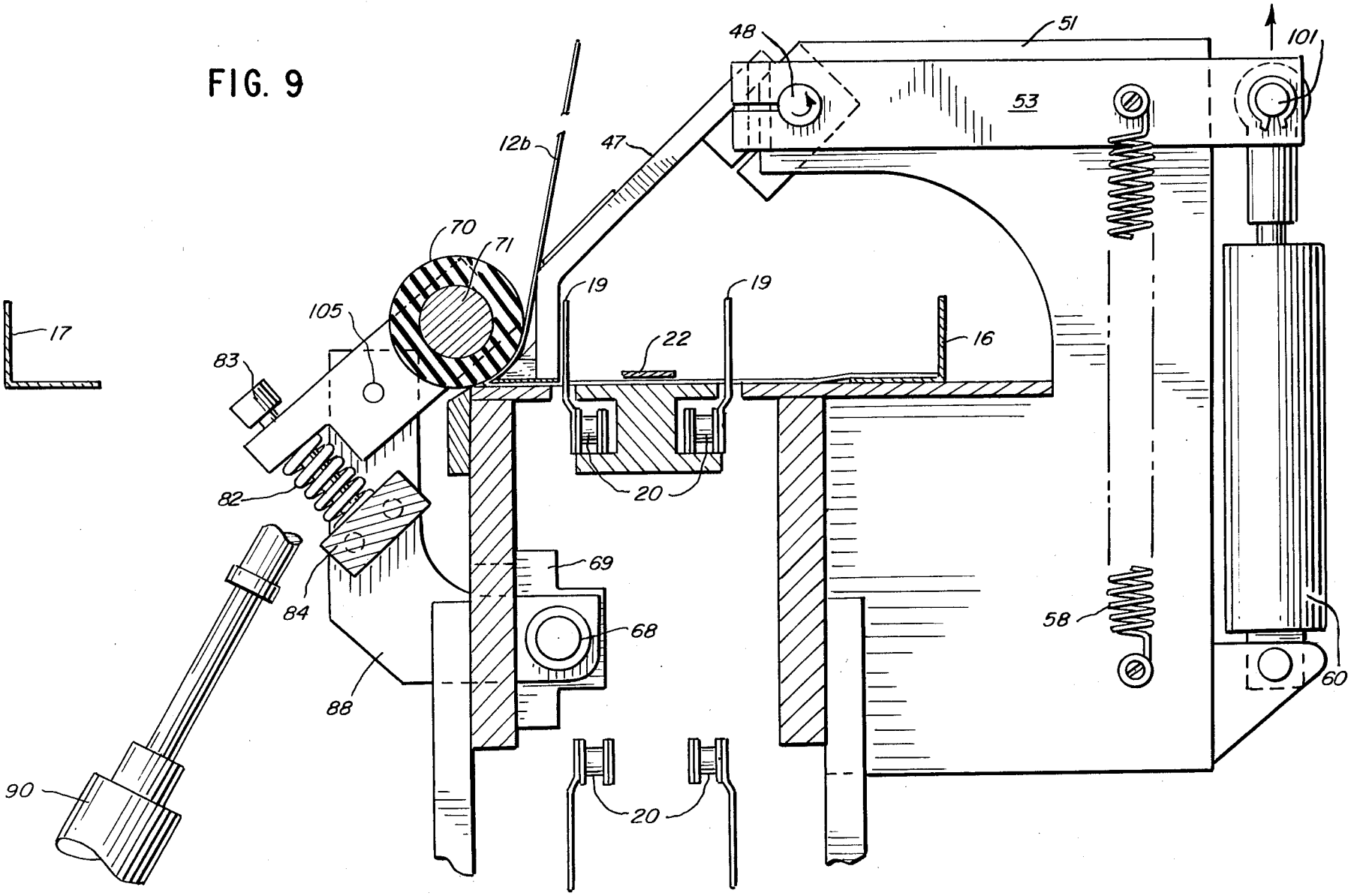
FIG. 9 is a view similar to FIG. 8 showing the arrangement of parts of the preferred roller folding means when in operative folding position.

The roller folding assembly 42 is synchronized to be activated at this time. The operation of the roller assembly 42 will be readily understood by reference to FIGS. 8 and 9 of the drawing. FIG. 8 shows the roller folding assembly in a retracted non-folding position and FIG. 9 shows it in operative sheet folding position. Thus, in response to an electrical signal compressed air is introduced into the lower part of air cylinder 90 causing the piston therein to move upwardly. The upward movement of the piston acting through boss element 89 moves drive bar 84 upwardly and inwardly causing the roller 70 to contact knife edge 62 and bevelled portion 61 of press bar 44 and to ride thereon as shown in FIG. 9. As drive bar 84 moves upwardly and inwardly, the rocker elements 86 and 88 pivot at pivot point 105 in a clockwise direction. The clockwise movement of the rocker elements 86 and 88 causes the pivot arms 77 and 78 to pivot inwardly against the biasing action of springs 81 and 82. The upward stroke of the piston within air cylinder 90 can be adjusted so as to insure that the roller 70 contacts crease bar 44 of the clamp folding assembly 40. For speed of operation, the upward stroke of the piston within air cylinder 90 can be adjusted so that when the roller first engages the knife edge 62 of crease bar 44 upward movement of the piston is arrested while permitting the inertial force to cause the roller to continue to traverse and roll on the bevelled portion 61 of crease bar 44, thereby completing the folding step. The direction of movement of the piston within air cylinder 90 is then reversed so that the roller folding assembly moves to a retracted, non-folding position as illustrated in FIG. 8 to await the movement of the next letter sheet to folding station B. After retraction of the roller folding assembly 42, the clamp assembly is released to likewise await the arrival of the next letter sheet or sheets.

Any suitable double-acting pneumatic cylinder having a reversible piston can be used to advance and retract roller folding assembly 42. Such double-acting pneumatic cylinders are available, for example, from Humphrey Products of Kalamazoo, Mich. The Humphrey double-acting air cylinders can be purchased with an internal magnet. Commercially available, reed-type electrical switches such as the Model RS-1 Switch of Humphrey Products can be used with the air cylinder to limit the piston stroke. Such reed-type switches operate to open or close an electrical circuit when the cylinder piston magnet is in the switch response area.

Reversing of the piston action within cylinder 90 can be done by such electrical switches at a very fast rate so that the roller folding assembly accomplishes the folding operations at high speed. It is desirable to operate the automated mailing system at a high speed such that on the order of 5000 envelopes per hour can be stuffed with letter sheet/insert sets. To accomplish the stuffing of 5000 envelopes per hour the folding operation should be synchronized to accomplish three folding operations in approximately two seconds.

FIG. 10 illustrates the operation of the optional second folding means which can be used at station C to reinforce the original crease or fold line. In the folding means shown in FIG. 10, The press bar 25 is adapted for reciprocating motion between an upper non-folding position (shown in dotted lines) and a lower folding position (shown in solid lines) by pivotal movement on pivot 29 in response to pneumatic cylinder 115. This pneumatic cylinder 115, like the air cylinders 60 and 90 which operate the first folding assemblies 40 and 42, is preferably a double-acting air cylinder having a reversible piston.

The advantages of the invention are numerous. By means of the present invention a letter sheet or a stack of letter sheets having one or more nested document inserts therein can be automatically prepared for mailing. The inserts are positioned within the mail so that the inserts are removed along with the letter sheets. By the invention, letter sheets of various sizes and thicknesses can be folded, with the fold line being accurately and consistently placed at a desired location, and this is accomplished at high speeds permitting mail to be prepared at a desirably high rate. The automatic mailing system of the invention requires no manual adjustment for handling a single letter sheet or a stack of such sheets and the sheets can be of varied size.

Those modifications and equivalents which fall within the spirit of the invention are to be considered a part thereof. Thus, for example, the principles of the present invention can be utilized to prepare automatic mass mailings which do not involve document inserts.

What is claimed is:

1. Document handling apparatus comprising:

(a) transport means for conveying at least one letter sheet with information indicia thereon along a transport path adjacent document handling means, (b) means for depositing at least one unfolded letter sheet with information indicia thereon onto said transport path, (c) an envelope stuffing station downstream of the said letter depositing means, and (d) folding means upstream of said envelope stuffing station for folding said letter sheet comprising a clamp assembly and a roller folding assembly movable into engagement with said clamp assembly to fold said letter sheet.

2. Document handling apparatus according to claim 1 wherein the clamp assembly is reciprocable between a non-clamping sheet position and a sheet clamping position and the roller folding assembly is movable into engagement with said clamp assembly when in sheet clamping position.

3. Document handling apparatus according to claim 1 wherein the clamp assembly is provided with a sheet-contacting crease bar having a bevelled forward portion terminating in a knife edge.

4. Document handling apparatus according to claim 1 wherein the clamp assembly and roller folding assembly are pneumatically operated.

5. Document handling apparatus according to claim 4 wherein double-acting air cylinders having reversible pistons therein are used for pneumatic operation.

6. Document handling apparatus according to claim 5 wherein the double-acting air cylinders are provided with sensing means to control the stroke of the pistons.

7. Document handling apparatus according to claim 6 wherein operation of said air cylinders is controlled by electric switches.

8. Apparatus for folding a letter sheet or a stack of letter sheets comprising a clamp assembly operative between an upper position and lower sheet-clamping position and an operatively disposed roller folding assembly adapted for reciprocable engagement with said clamp assembly whereby said letter sheet or stack of letter sheets is folded along a crease line at a desired location.

9. Apparatus according to claim 8 wherein the clamp assembly is provided with a sheet-contacting crease bar having a bevelled forward portions terminating in a knife edge.

10. Apparatus according to claim 8 wherein the clamp assembly and roller folding assembly are pneumatically operated.

11. Apparatus according to claim 10 wherein double-acting air cylinders having reversible pistons therein are used for pneumatic operation.

12. Apparatus according to claim 11 wherein operation of said air cylinders is controlled by electric switches.

13. Apparatus according to claim 11 wherein the double-acting air cylinders are provided with sensing means to control the stroke of the pistons.

14. Document handling apparatus comprising:

(a) transport means for conveying at least one letter sheet with information indicia thereon along a transport path adjacent document handling means, (b) means for depositing at least one unfolded letter sheet with information indicia thereon onto said transport path, (c) at least one document insert station adjacent said transport means, (d) folding means upstream of the first of said document insert stations for folding said letter sheet comprising a clamp assembly and roller folding assembly movable into engagement with said clamp assembly to fold said letter sheet, (e) means upstream of the first of said document insert stations for spreading the folds of said letters sheet and maintaining the folds of said sheet in spread position at each of said document insert stations whereby said document inserts are inserted between the folds of said sheet at each document insert station, and (f) an envelope stuffing station downstream of the last of said document insert stations.

15. Document handling apparatus according to claim 14 having upstanding longitudinally extending spaced guide rails for maintaining said paper sheet in alignment during the folding operation.

16. Document handling apparatus according to claim 14 having a longitudinally extending hold down element spaced above said transport means under which a portion of the paper sheet passes during folding thereof.

17. Document handling apparatus according to claim 14 wherein the clamp assembly is reciprocable between a non-clamping sheet position and a sheet clamping position and the roller folding assembly is movable into engagement with said clamp assembly when in sheet clamping position.

18. Document handling apparatus according to claim 14 wherein the clamp assembly is provided with a sheet-contacting crease bar having a bevelled forward portion terminating in a knife edge.

19. Document handling apparatus according to claim 14 wherein the clamp assembly and roller folding assembly are pneumatically operated.

20. Document handling apparatus according to claim 19 wherein double-acting air cylinders having reversible pistons therein are used for pneumatic operation.

21. Document handling apparatus according to claim 20 wherein operation of said air cylinders is controlled by electric switches.

22. Document handling apparatus according to claim 14 having a first and second means upstream of the first of said document insert stations for folding the letter sheet.

23. Document handling apparatus according to claim 22 wherein said second means for folding the letter sheet comprises a press bar adapted for vertical reciprocating movement between an upper position and a lower folding position in which it exerts a pressing force along a crease line of the said letter sheet.

24. Document handling apparatus according to claim 22 wherein said second means for folding the letter sheet is pneumatically operated.

25. Document handling apparatus according to claim 24 wherein a double-acting air cylinder having a reversible piston therein is used for pneumatic operation.

26. Document handling apparatus according to claim 25 wherein operation of said air cylinder is controlled by an electrical switch.

27. Apparatus according to claim 25 wherein the double-acting air cylinder is provided with sensing means to control the stroke of the pistons.

28. A method of preparing mailings which comprises;

(a) depositing at least one unfolded letter sheet on transport means, (b) folding said letter sheet by passing the sheet to a clamp assembly and moving a roller folding assembly into engagement with said clamp assembly to fold said sheet, (c) transporting said folded letter sheet to an envelope stuffing station, and (d) at said envelope stuffing station shoving said folded letter sheet into an open envelope.

29. A method in accordance with claim 28 wherein the clamp assembly is provided with a sheet-contacting crease bar having a bevelled forward portion terminating in a knife edge.

30. A method in accordance with claim 28 wherein pneumatic means are employed to operate the clamp assembly and roller folding assembly.

31. A method in accordance with claim 30 wherein double-acting air cylinders having reversible pistons therein are employed to operate the clamp assembly and roll folding assembly.

32. A method in accordance with claim 31 wherein operation of said air cylinders is controlled by electric switches.

33. A method in accordance with claim 28 wherein a second folding step is accomplished by a press bar adapted for vertical reciprocating movement between an upper position and a lower folding position in which it exerts a pressing force along a crease line of the said letter sheet.

34. A method in accordance with claim 33 wherein said second folding step is pneumatically accomplished.

35. A method in accordance with claim 34 wherein a double-acting air cylinder having a reversible piston therein is used in accomplishing the second folding step.

36. A method in accordance with claim 35 wherein said air cylinder is controlled by an electric switch.

37. A method of preparing mailings which comprises:

(a) depositing at least one unfolded letter sheet on transport means, (b) folding said letter sheet by passing the sheet to a clamp assembly and moving a roller folding assembly into engagement with the clamp assembly to fold said sheet, (c) transporting said folded letter sheet while maintaining the folds thereof separated to at least one document insert station whereat one or more document inserts are inserted between the folds of said letter sheet, and (d) transporting said folded letter sheet with at least one document insert nesting between the folds to an envelope stuffing station and thereat shoving said folded letter sheet with at least one document insert nested between the folds into an open envelope.

38. A method in accordance with claim 37 wherein a plurality of letters sheets in an aligned stack are prepared.

39. A method in accordance with claim 17 wherein said folded letter sheet is transported to more than one document insert station whereat one or more document inserts are inserted between the folds of said letter sheet.

40. A method in accordance with claim 17 wherein a portion of said letter sheet is passed beneath a hold-down element during folding thereof and insertion of document inserts.

41. A method in accordance with claim 17 wherein an intercept element is interspersed between the folds of said letter sheet to maintain the folds separated during insertion of document inserts.

42. A method in accordance with claim 17 wherein the clamp assembly is provided with a sheet-contacting crease bar having a bevelled forward portion terminating in a knife edge.

43. A method in accordance with claim 17 wherein pneumatic means are employed to operate the clamp assembly and roller folding assembly.

44. A method in accordance with claim 17 wherein double-acting air cylinders having reversible pistons therein are employed to operate the clamp assembly and roller folding assembly.

45. A method in accordance with claim 44 wherein operation of said air cylinders is controlled by electric switches.

46. A method in accordance with claim 43 wherein the double-acting air cylinders are provided with sensing means to control the stroke of the pistons.

47. A method in accordance with claim 37 wherein the second folding step is accomplished by a press bar adapted for vertical reciprocating movement between an upper position and a lower folding position in which it exerts a pressing force along a crease line of the said letter sheet.

48. A method in accordance with claim 47 wherein said second folding step is pneumatically accomplished.

49. A method in accordance with claim 48 wherein a double-acting air cylinder having a reversible piston therein is used in accomplishing the second folding step.

50. A method in accordance with claim 49 wherein said air cylinder is controlled by an electric switch.

51. A method in accordance with claim 49 wherein the double-acting air cylinder is provided with sensing means to control the stroke of the pistons.

52. A method of folding at least one letter sheet which comprises passing said sheet to a clamp assembly operative between an upper non-clamping position and a lower sheet-clamping position and moving a roller folding assembly into engagement with the clamp assembly when in the lower sheet-clamping position to fold said letter sheet along a crease line at a desired location.

53. A method according to claim 52 wherein the clamp assembly is provided with a sheet-contacting crease bar having a bevelled forward portion terminating in a knife edge.

54. A method according to claim 52 wherein the clamp assembly and roller folding assembly are pneumatically operated.

55. A method according to claim 52 wherein double-acting air cylinders having reversible pistons therein are used for pneumatic operation.

56. A method according to claim 55 wherein operation of said air cylinders is controlled by electric switches.

57. A method according to claim 55 wherein the double-acting air cylinders are provided with sensing means to control the stroke of the pistons.

* * * * *

UNITED STATES PATENT AND TRADEMARK OFFICE

CERTIFICATE OF CORRECTION

PATENT NO. : 4,784,379

DATED : November 15, 1988

INVENTOR(S) : Gary L. Vander Syde et al.

It is certified that error appears in the above-identified patent and that said Letters Patent is hereby corrected as shown below:

Column 8, line 62, "claim 6" should be -- claim 5 --

Signed and Sealed this

Twenty-fifth Day of July, 1989

*Attest:*

DONALD J. QUIGG

*Attesting Officer*

*Commissioner of Patents and Trademarks*